US011499775B2

(12) United States Patent
Roberts et al.

(10) Patent No.: US 11,499,775 B2
(45) Date of Patent: Nov. 15, 2022

(54) LIQUEFACTION SYSTEM

(71) Applicant: Air Products and Chemicals, Inc., Allentown, PA (US)

(72) Inventors: Mark Julian Roberts, Whitehall, PA (US); John A. Dally, Fountain Hill, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 60 days.

(21) Appl. No.: 16/916,918

(22) Filed: Jun. 30, 2020

(65) Prior Publication Data

US 2021/0404738 A1 Dec. 30, 2021

(51) Int. Cl.
*F25J 1/02* (2006.01)
*F25J 1/00* (2006.01)

(52) U.S. Cl.
CPC ..... *F25J 1/0035* (2013.01); *F25J 1/004* (2013.01); *F25J 1/0022* (2013.01); *F25J 1/0037* (2013.01); *F25J 1/0052* (2013.01); *F25J 1/0202* (2013.01); *F25J 1/0288* (2013.01); *F25J 2205/02* (2013.01); *F25J 2210/06* (2013.01); *F25J 2220/64* (2013.01); *F25J 2230/30* (2013.01); *F25J 2270/06* (2013.01)

(58) Field of Classification Search
CPC ..... F25J 1/0022; F25J 1/0035; F25J 1/0037; F25J 1/004; F25J 1/0288; F25J 1/0264; F25J 1/0202; F25J 2270/06; F25J 2230/30; F25J 2210/06; F25J 2220/64; F25J 2205/02
See application file for complete search history.

(56) References Cited

U.S. PATENT DOCUMENTS

| | | | |
|---|---|---|---|
| 9,310,127 | B2 | 4/2016 | Teo |
| 10,641,548 | B2 | 5/2020 | Skinner et al. |
| 2013/0061633 | A1 | 3/2013 | Mak et al. |
| 2014/0083132 | A1 | 3/2014 | Maunder et al. |
| 2016/0209118 | A1 | 7/2016 | Roberts et al. |
| 2017/0167786 | A1 | 6/2017 | Pierre, Jr. |
| 2018/0231303 | A1 | 8/2018 | Pierre, Jr. |
| 2019/0346203 | A1 | 11/2019 | Chen et al. |

FOREIGN PATENT DOCUMENTS

| | | |
|---|---|---|
| EP | 2713127 | 4/2014 |
| GB | 2541464 | 2/2017 |
| JP | 2009019192 | 1/2009 |
| WO | 2017162566 | 9/2017 |

*Primary Examiner* — Brian M King
(74) *Attorney, Agent, or Firm* — Amy Carr-Trexler

(57) ABSTRACT

Described herein are methods and systems for liquefying natural gas using an open-loop natural gas refrigeration cycle; coil wound heat exchanger units suitable for cooling one or more feed streams, such as for example one or more natural gas feed streams, via indirect heat exchange with a gaseous refrigerant; and methods and systems for removing heavy components from a natural gas prior to liquefying the natural gas using an open-loop natural gas refrigeration cycle.

17 Claims, 3 Drawing Sheets

LIQUEFACTION SYSTEM

BACKGROUND

The present invention relates generally to methods and systems for liquefying natural gas using an open-loop natural gas refrigeration cycle. The present invention also relates to a coil wound heat exchanger unit suitable for cooling one or more feed streams, such as for example one or more natural gas feed streams, via indirect heat exchange with a gaseous refrigerant. The present invention furthermore relates to methods and systems for removing heavy components from a natural gas prior to liquefying the natural gas using an open-loop natural gas refrigeration cycle.

The liquefaction of natural gas is an important industrial process. The worldwide production capacity for LNG is more than 300 million tonnes per annum (MTPA). A number of methods and systems for pre-treating, cooling and liquefying natural gas are well known in the art.

In a typical method and system for liquefying natural gas, a natural gas feed stream is cooled and liquefied via indirect heat exchange with one or more refrigerants circulating in open-loop or closed-loop cycles. The cooling and liquefaction of the natural gas takes place in one or more heat exchanger sections, which can be of a number of different types, such as but not limited to heat exchangers of the coil-wound, shell and tube or plate and fin type. Prior to being cooled and liquefied, the natural gas feed stream is treated if and as necessary to reduce the levels of any (relatively) high freezing point components, such as moisture, acid gases, mercury and/or heavier hydrocarbons, down to such levels as are necessary to avoid freezing or other operational problems in the heat exchanger section or sections in which the natural gas is to be cooled and liquefied.

US2017/0167786A1 discloses a method and system for liquefying natural gas using an open-loop natural gas refrigeration cycle. With reference in particular to FIG. 6 of this document, a high pressure combined feed stream (formed from combining and compressing a natural gas feed stream and a stream of recycled gas) is expanded to cool the stream and is then divided into a first refrigerant stream, a second refrigerant stream and a first feed stream. The first refrigerant stream is expanded and then passed through and warmed in one of the passages in the cold side of a first heat exchanger. It is not stated whether the first refrigerant stream, after expansion, is gaseous, liquid or two phase. The second refrigerant stream is passed through and cooled in one of the passages in the warm side of the first heat exchanger, and is then expanded to form a two phase stream that is separated to form a gaseous refrigerant stream and a first LNG stream, with the gaseous refrigerant stream being passed through and warmed in another one of the passages in the cold side of the first heat exchanger. The first feed stream is passed through and cooled and liquefied in another one of the passages in the warm side of the first heat exchanger to form a second LNG stream, which is then further cooled in a flash gas heat exchanger. The first and second LNG streams are then flashed and sent to an end flash separator to form a flash gas stream and LNG product stream, with the flash gas stream being warmed in the flash gas heat exchanger and then further warmed in another of the passages in the cold side of the first heat exchanger. The warmed first refrigerant stream, warmed gaseous refrigerant stream and warmed flash gas stream are then compressed and combined to form the stream of recycled gas that is combined with the natural gas feed stream. It should be noted that as the first heat exchanger utilizes three separate streams on the cold side of the heat exchanger to provide cooling duty to the heat exchanger, this effectively precludes the use of a coil wound heat exchanger for this heat exchanger, as a coil wound heat exchanger can only accommodate one refrigerant stream on the shell side (normally the cold side) of the heat exchanger. While in theory it would be possible to allocate one or more of the low-pressure refrigerant streams to one of the passages through the tube side (normally the warm side) of a coil wound exchanger, the high pressure drop losses on the tube side would result in a very high power requirement, rendering this impractical.

US2014/0083132A1 discloses another method and system for liquefying natural gas using an open-loop natural gas refrigeration cycle. With reference in particular to FIG. 1 of this document, a recycled gas stream is split into two parts. One part is expanded to form a first refrigerant stream that is then warmed in first and second pre-cooler heat exchangers. The other part is combined with a natural gas feed stream to form a combined feed stream. The combined feed stream is then cooled in the first pre-cooler heat exchanger, after which heavy components (specifically heavier hydrocarbons) are removed (these being separated as a natural gas liquids (NGL) stream). The heavy component depleted combined stream is then further cooled in the second pre-cooler heat exchanger before being spit into a first feed stream and second feed stream. The first feed stream is cooled and liquefied in a main heat exchanger to for a first LNG stream. The second feed stream is expanded to form a two-phase stream than is then separated to form a second LNG stream and a gaseous refrigerant stream. The gaseous refrigerant stream is warmed in the main heat exchanger and then further warmed in the precooler heat exchangers. The first and second LNG streams are flashed and then separated into a flash gas stream and LNG product, with the flash gas stream being warmed in the main heat exchanger and then further warmed in the pre-cooler heat exchangers. The warmed refrigerant streams and flash gas stream are then compressed and combined to form the recycled gas stream.

US2019/0346203A1 discloses a combined heat exchanger and separator unit suitable for receiving and separating a flashed LNG stream to form a flash gas stream and LNG product, and for warming the separated flash gas via indirect heat exchange with a feed stream to cool the feed stream and recover refrigeration from the flash gas stream. The unit comprises a heat exchanger section and a separation section that are enclosed within the same shell casing, the heat exchanger section being a coil wound heat exchanger section and being located above separation section such that flash gas separated from the flashed LNG stream in the separation section rises through the shell side of the heat exchanger section providing refrigeration to the heat exchanger section.

U.S. Pat. No. 9,310,127 discloses a method for removing heavy components from a natural gas prior to liquefying the natural gas using a closed loop refrigerant cycle. With reference in particular to FIG. 2 of this document, a natural gas feed stream is cooled and expanded and introduced into a distillation column to remove heavy components (specifically heavier hydrocarbons) from the feed stream (the heavier hydrocarbons being separated as a natural gas liquids stream). The heavy component depleted natural gas feed stream is then compressed in a compressor train before being liquefied in a main heat exchanger via indirect heat exchange with a refrigerant circulating in a closed loop circuit. The resulting LNG stream is then flashed to produce an LNG product and a flash gas. A portion of the flash gas may be recycled back into the heavy component depleted natural gas feed stream.

U.S. Pat. No. 10,641,548 discloses a method for removing heavy components from a natural gas and liquefying the natural gas using an open loop refrigeration cycle. With reference in particular to FIG. 1 of this document, a natural gas feed stream is combined with a first recycle stream to produce a first combined feed stream, and the first combined feed stream is then expanded to produce a first cooled combined feed stream. The first cooled combined feed stream is then separated in a separator into a gaseous feed stream depleted in heavy components (specifically heavier hydrocarbons) and a heavy component enriched liquid stream (an NGL stream). The heavy component depleted gaseous feed stream is then warmed in a first heat exchanger and combined and compressed with a second recycle stream to form a second combined feed stream. The second combined feed stream is split to form the first recycle stream and a first feed stream. The first feed stream is cooled in the first heat exchanger and then split to form second and third feed streams. The second feed stream is further cooled in a second heat exchanger to form a first LNG stream. The third feed stream is expanded and separated to form a second LNG stream and a gaseous refrigerant stream. The gaseous refrigerant stream is then warmed in the second heat exchanger and first heat exchanger to form the second recycle stream.

BRIEF SUMMARY

Disclosed herein are: methods and systems for liquefying natural gas using an open-loop natural gas refrigeration cycle; coil wound heat exchanger units suitable for cooling one or more feed streams, such as for example one or more natural gas feed streams, via indirect heat exchange with a gaseous refrigerant; and methods and systems for removing heavy components from a natural gas prior to liquefying the natural gas using an open-loop natural gas refrigeration cycle. The disclosed methods and systems and units provide various benefits related to improved efficiency, reduced capital cost, reduced footprint and/or improved mechanical design.

Several preferred aspects of the apparatus, systems and method according to the present invention are outlined below.

Aspect 1: A method of liquefying natural gas using an open-loop natural gas refrigeration cycle, the method comprising the steps of (a) forming a high pressure combined feed stream by combining one or streams of recycled gas with a natural gas feed stream to form a combined feed stream and compressing either the combined feed stream, or the one or more streams of recycled gas prior to combination with the natural gas feed stream, or both;

(b) expanding the high pressure combined feed stream to cool the stream, thereby forming a cooled combined feed stream;

(c) dividing the cooled combined feed stream into at least three separate streams, thereby forming a first feed stream, a second feed stream and a third feed stream;

(d) further cooling the first feed stream via indirect heat exchange with a gaseous refrigerant stream, the first feed stream being cooled to form a first LNG stream and the gaseous refrigerant stream being warmed to form a stream of warmed gaseous refrigerant that forms one of the one or more streams of recycled gas;

(e) further expanding the second feed stream to further cool said stream thereby forming a further expanded and cooled second feed stream that is two-phase, having liquid and vapor fractions, and separating said liquid and vapor fractions to form the gaseous refrigerant stream from the vapor fraction and a second LNG stream from the liquid fraction;

(f) further cooling the third feed stream, via indirect heat exchange with a first flash gas stream, to form a third LNG stream; and (g) flashing the first, second and third LNG streams such that each stream has liquid and vapor fractions, and separating said liquid and vapor fractions to form a first LNG product stream from the liquid fraction of one or more of said streams and the first flash gas stream from the vapor fraction of one or more of said streams.

Aspect 2: A method according to Aspect 1, wherein the high pressure combined feed stream is at a pressure of at least 150 bara and more preferably at least 200 bara.

Aspect 3: A method according to Aspect 1 or 2, wherein step (a) further comprises cooling the one or more streams of recycled gas and/or the combined feed stream after compression via indirect heat exchange with one or more ambient temperature fluids, such that the high pressure combined feed stream is at about ambient temperature.

Aspect 4: A method according to any one of Aspects 1 to 3, wherein the cooled combined feed stream is at a temperature of below 0° C., and more preferably is at a temperature of −20 to −40° C., more preferably about −30° C., and wherein the further expanded and cooled second feed stream at a temperature of −110 to −140° C., more preferably about −125° C.

Aspect 5: A method according to any one of Aspects 1 to 4, wherein in steps (b) and (e) the high pressure combined feed stream and the second feed stream are each expanded substantially isentropically.

Aspect 6: A method according to any one of Aspects 1 to 5, wherein in step (c) the cooled combined feed stream is divided such that the second feed stream has the largest mass flow rate of the separate streams into which the cooled and combined feed stream is divided, and the first feed stream has the second largest flow rate of the streams into which the cooled and combined feed stream is divided.

Aspect 7: A method according to any one of Aspects 1 to 6, wherein the mass flow rate of the second feed stream is 65 to 75%, and more preferably about 70%, of the mass flow rate of the cooled combined feed stream; and wherein the mass flow rate of the first feed stream is 20 to 30%, and more preferably about 25%, of the mass flow rate of the cooled combined feed stream.

Aspect 8: A method according to any one of Aspects 1 to 7, wherein the vapor fraction of the further expanded and cooled second feed stream constitutes the majority of, and more preferably from 75 to 95 mole % of said stream.

Aspect 9: A method according to any one of Aspects 1 to 8, wherein the first flash gas stream, after being warmed in step (f) via indirect heat exchange with the third feed stream, forms another one of the one or more streams of recycled gas.

Aspect 10: A method according to any one of Aspects 1 to 9, wherein in step (d) the first feed stream is further cooled via indirect heat exchange with the gaseous refrigerant stream in a coil wound heat exchanger section, the first feed stream being further cooled in the tube side of the coil wound heat exchanger section and the gaseous refrigerant stream being warmed in the shell side of the coil wound heat exchanger section.

Aspect 11: A method according to any one of Aspects 1 to 10, wherein step (a) comprises forming the high pressure combined feed stream by combining one or streams of recycled gas with the natural gas feed stream to form the combined feed stream and then compressing the combined feed stream.

Aspect 12: A method according to any one of Aspects 1 to 11, wherein step (g) comprises flashing the first, second and third LNG streams such that each stream has liquid and vapor fractions, and separating said liquid and vapor fractions to form the first LNG product stream from the liquid fractions of all of said streams and the first flash gas stream from the vapor fractions of all of said streams.

Aspect 13: A method according to any one of Aspects 1 to 12, wherein step (c) comprises dividing the cooled combined feed stream into at least four separate streams, thereby forming a first feed stream, a second feed stream, a third feed stream and a fourth feed stream; and wherein the method further comprises the steps of:

(h) further cooling the fourth feed stream, via indirect heat exchange with a second flash gas stream, to form a fourth LNG stream; and (i) flashing the fourth LNG stream and the first LNG product stream such that each stream has liquid and vapor fractions, and separating said liquid and vapor fractions to form a second LNG product stream from the liquid fraction of one or both of said streams and the second flash gas stream from the vapor fraction of one or both of said streams Aspect 14: A method according to Aspect 13, wherein step (i) comprises flashing the fourth LNG stream and the first LNG product stream such that each stream has liquid and vapor fractions, and separating said liquid and vapor fractions to form the second LNG product stream from the liquid fractions of both of said streams and the second flash gas stream from the vapor fractions of both of said streams.

Aspect 15: A system for liquefying natural gas via the method of any one of Aspects 1 to 14, the system comprising:

a compression train, comprising one or more compressors, for forming a high pressure combined feed stream by combining one or streams of recycled gas with a natural gas feed stream to form a combined feed stream and compressing either the combined feed stream, or the one or more recycle streams prior to combination with the natural gas feed stream, or both;

a first expansion device, in fluid flow communication with the compression train, for receiving and expanding the high pressure combined feed stream to cool the stream and thereby form a cooled combined feed stream;

a set of conduits in fluid flow communication with the first expansion device for dividing the cooled combined feed stream into at least three separate streams comprising a first feed stream, a second feed stream and a third feed stream, the set of conduits comprising a first conduit for receiving the first feed stream, a second conduit for receiving the second feed stream and a third conduit for receiving the third feed stream;

a first heat exchanger section in fluid flow communication with the first conduit for receiving and further cooling the first feed stream via indirect heat exchange with a gaseous refrigerant stream, the first feed stream being cooled to form a first LNG stream and the gaseous refrigerant stream being warmed to form a stream of warmed gaseous refrigerant that forms one of the one or more streams of recycled gas;

a second expansion device in fluid flow communication with the second conduit for receiving and further expanding the second feed stream to further cool said stream and thereby form a further expanded and cooled second feed stream that is two-phase, having liquid and vapor fractions;

a first separation section, in fluid flow communication with the second expansion device and first heat exchanger section, for receiving the further expanded and cooled second feed stream and separating the liquid and vapor fractions of said stream to form the gaseous refrigerant stream from the vapor fraction and a second LNG stream from the liquid fraction;

a second heat exchanger section, in fluid flow communication with the third conduit for receiving and further cooling the third feed stream, via indirect heat exchange with a first flash gas stream, to form a third LNG stream; and a third expansion device or set of expansion devices for receiving and flashing the first, second and third LNG streams such that each stream has liquid and vapor fractions, and a second separation section or set of separation sections, in fluid flow communication with the third expansion device or set of expansion devices, for separating said liquid and vapor fractions to form a first LNG product stream from the liquid fraction of one or more of said streams and the first flash gas stream from the vapor fraction of one or more of said streams.

Aspect 16: A coil wound heat exchanger unit suitable for cooling one or more feed streams via indirect heat exchange with a gaseous refrigerant stream, the coil wound heat exchanger unit comprising a shell casing enclosing a heat exchanger section, a separation section located above the heat exchanger section, a partition separating the heat exchanger section from the separation section, and one or more conduits between the heat exchanger section and separation section extending through the partition, wherein:

the heat exchanger section comprises at least one coil wound tube bundle defining a tube side and a shell side of the heat exchanger section, the tube side defining one or more passages through the heat exchanger section for cooling the one or more feed streams to form one or more cooled feed streams, and the shell side defining a passage through the heat exchanger section for warming the gaseous refrigerant stream to form a stream of warmed gaseous refrigerant;

the separation section is configured to receive a two phase stream, having vapor and liquid fractions, and separate the liquid and vapor fractions of said stream, with the liquid fraction collecting at the bottom of the separation section and the vapor fraction collecting at the top of the separation section;

the partition and the one or more conduits are configured so as to prevent flow of fluid between the separation section and heat exchanger section other than through the one or more conduits, the one or more conduits each having an inlet located above the partition towards the top of the separation section and an outlet located below the partition towards the top of the heat exchanger section on the shell side of the heat exchanger section, whereby liquid collecting at the bottom of the separation section cannot flow into the heat exchanger section, whereas vapor collecting at the top of the separation section can flow through the one or more conduits and into the top of the shell side of the heat exchanger section to form the gaseous refrigerant stream that flows through and is warmed in the shell side of the heat exchanger section; and the shell casing has a first inlet or set of inlets in fluid flow communication with the tube side of the heat exchanger section for introducing the one or more feed streams; a first outlet or set of outlets in fluid flow communication with the tube side of the heat exchanger section for withdrawing the one or more cooled feed streams; a second inlet in fluid flow communication with the separation section for introducing the two phase stream; a second outlet in fluid flow communication with the separation section for withdrawing a stream of the liquid collecting at the bottom of the separation section; and a third outlet in fluid flow communication with the shell side of the heat exchanger section for withdrawing the stream of warmed gaseous refrigerant from the bottom of the shell side of the heat exchanger section Aspect 17: A coil wound heat exchanger unit according to Aspect 16, wherein the first inlet or set of inlets of the shell casing are for introducing the one or more feed streams into the bottom of the tube side of the heat exchanger section; and wherein the first outlet or set of outlets of the shell casing are for withdrawing the one or more cooled feed streams from the top of the tube side of the heat exchanger section.

Aspect 18: A coil wound heat exchanger unit according to Aspect 16 or 17, wherein the second inlet of the shell casing is located so as to introduce the two phase stream into the separation section at a location below the location of the inlets to each of the one or more conduits.

Aspect 19: A coil wound heat exchanger unit according to any one of Aspects 16 to 18, wherein the coil wound heat exchanger unit further comprises a mist eliminator in the separation section located between the second inlet of the shell casing and the inlets to each of the one or more conduits.

Aspect 20: A coil wound heat exchanger unit according to any one of Aspects 16 to 19, wherein the heat exchanger section further comprises a mandrel around which the tubes of the coil wound tube bundle are wound, and wherein the mandrel extends upwards through the partition, said upwards extension of the mandrel being hollow and forming at least one of the one or more conduits that extend through the partition.

Aspect 21: A system according to Aspect 15 including a coil-wound heat exchanger unit according to any one of Aspects 16 to 20, wherein:

the heat exchanger section of the coil wound heat exchanger unit is the first heat exchanger section of the system, the one or more feed streams cooled by the coil wound heat exchanger unit being the first feed stream and the one or more cooled feed streams withdrawn from the first outlet or set of outlets being the first LNG stream; and the separation section of the coil-wound heat exchanger unit is the first separation section of the system, the two phase stream received by the separation section being the further expanded and cooled second feed stream, and the stream of the liquid collecting at the bottom of the separation section that is withdrawn from the second outlet being the second LNG stream.

Aspect 22: A method of cooling one or more feed streams using a coil wound heat exchanger unit according to any one of Aspects 16 to 20, the method comprising:

introducing the one or more feed streams into the tube side of the heat exchanger section through the first inlet or set of inlets of the shell casing;

withdrawing one or more cooled feed streams from tube side of the heat exchanger section through the first outlet or set of outlets of the shell casing;

introducing a two-phase stream into the separation section through the second inlet of the shell casing;

withdrawing a stream of the liquid collecting at the bottom of the separation section through the second outlet of the shell casing; and withdrawing a stream of warmed gaseous refrigerant from the bottom of the shell side of the heat exchanger section through the third outlet of the shell casing.

Aspect 23: A method according to Aspect 22, wherein the one or more feed streams comprise a natural gas feed stream.

Aspect 24: A method according to Aspect 23, wherein the one or more cooled feed streams comprise an LNG stream.

Aspect 25: A method according to Aspect 23 or 24, wherein the two phase stream is an expanded and cooled natural gas feed stream.

Aspect 26: A method of liquefying natural gas according to any one of Aspects 1 to 14, wherein the method uses a coil wound heat exchanger unit according to any one of Aspects 16 to 20 for carrying out step (d) and for the separating of the liquid and vapor fractions of the further expanded and cooled second feed stream to form the gaseous refrigerant stream and a second LNG stream in step (e); the one or more feed streams cooled by the coil wound heat exchanger unit being the first feed stream; the one or more cooled feed streams withdrawn from the first outlet or set of outlets of the coil wound heat exchanger unit shell casing being the first LNG stream; the two phase stream received by the separation section of the coil wound heat exchanger unit being the further expanded and cooled second feed stream; and the stream of the liquid collecting at the bottom of the separation section that is withdrawn from the second outlet of the coil wound heat exchanger unit shell casing being the second LNG stream.

Aspect 27: A method of removing heavy components from a natural gas prior to liquefying the natural gas using an open-loop natural gas refrigeration cycle, the method comprising the steps of:

(i) expanding a natural gas feed stream, containing heavy components, to form a cooled natural gas feed stream;

(ii) separating the cooled natural gas feed stream into a gaseous natural gas feed stream that is depleted in heavy components and a liquid stream that is enriched in heavy components;

(iii) combining the gaseous natural gas feed stream with one or more streams of recycled gas to form a combined feed stream, said streams being combined at a pressure below the critical pressure of methane, and the gaseous natural gas feed stream not being subjected to externally driven compression prior to being combined with the one or more streams of recycled gas;

(iv) compressing the combined feed stream to form a high pressure combined feed stream; and (v) liquefying a first portion of the high pressure combined feed stream in an open-loop natural gas refrigeration cycle using a second portion of the high pressure combined feed stream as the refrigerant for providing the cooling duty for liquefying the first portion, the second portion once warmed forming one or more of the one or more streams of recycled gas;

wherein steps (i) and (ii) are carried out prior to the natural gas stream being combined with any streams of recycled gas from the open-loop natural gas refrigeration cycle.

Aspect 28: A method of liquefying natural gas according to any one of Aspects 1 to 14, wherein step (a) comprises:

(i) expanding a natural gas feed stream, containing heavy components, to form a cooled natural gas feed stream;

(ii) separating the cooled natural gas feed stream into a gaseous natural gas feed stream that is depleted in heavy components and a liquid stream that is enriched in heavy components;

(iii) combining the gaseous natural gas feed stream with the one or more streams of recycled gas to form the combined feed stream, said streams being combined at a pressure below the critical pressure of methane, and the gaseous natural gas feed stream not being subjected to externally driven compression prior to being combined with the one or more streams of recycled gas; and (iv) compressing the combined feed stream to form the high pressure combined feed stream.

Aspect 29: A system for carrying out the method of Aspect 27, the system comprising:

a first expansion device for receiving and expanding a natural gas feed stream, containing heavy components, to form a cooled natural gas feed stream;

one or more separation devices in fluid flow communication with the first expansion device for receiving and separating the cooled natural gas feed stream into a gaseous natural gas feed stream that is depleted in heavy components and a liquid stream that is enriched in heavy components;

a compression train, comprising one or more compressors, for receiving the gaseous natural gas feed stream and one or more streams of recycled gas, combining said streams to form a combined feed stream, and compressing the combined feed stream to form a high pressure combined feed stream, the gaseous natural gas feed stream and one or more streams of recycled gas being combined at a pressure below the critical pressure of methane and the gaseous natural gas feed stream not being subjected to externally driven compression prior to being combined with the one or more streams of recycled gas; and a liquefaction system in fluid flow communication with the compression train for liquefying a first portion of the high pressure combined feed stream in an open-loop natural gas refrigeration cycle using a second portion of the high pressure combined feed stream as the refrigerant for providing the cooling duty for liquefying the first portion, the second portion once warmed forming one or more of the one or more streams of recycled gas.

Aspect 30: A system according to Aspect 15, wherein the compression train forms the high pressure combined feed stream by combining the one or streams of recycled gas with a gaseous natural gas feed stream that is depleted in heavy components to form a combined feed stream, and compressing the combined feed stream to form the high pressure combined feed stream, the gaseous natural gas feed stream and one or more streams of recycled gas being combined at a pressure below the critical pressure of methane and the gaseous natural gas feed stream not being subjected to externally driven compression prior to being combined with the one or more streams of recycled gas; and wherein the system further comprises:

a fourth expansion device for receiving and expanding a natural gas feed stream, containing heavy components, to form a cooled natural gas feed stream; and one or more separation devices in fluid flow communication with the fourth expansion device for receiving and separating the cooled natural gas feed stream into the gaseous natural gas feed stream that is depleted in heavy components and a liquid stream that is enriched in heavy components.

DETAILED DESCRIPTION

Figure 1:
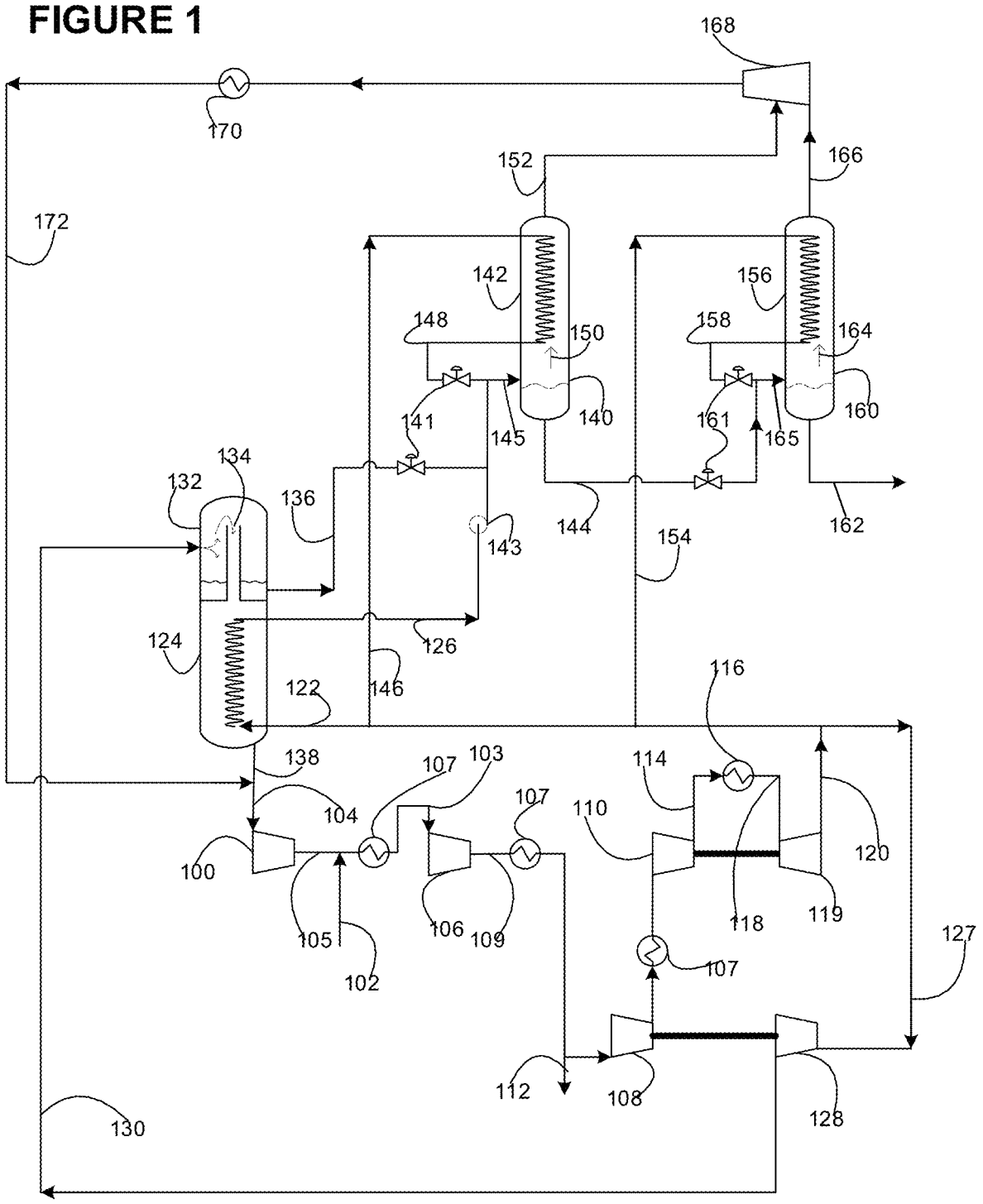
FIG. 1 is a schematic flow diagram depicting a natural gas liquefaction method and system utilizing an open-loop refrigeration cycle.

Described herein are: methods and systems for liquefying natural gas using an open-loop natural gas refrigeration cycle; coil wound heat exchanger units suitable for cooling one or more feed streams, such as for example one or more natural gas feed streams, via indirect heat exchange with a gaseous refrigerant; and methods and systems for removing heavy components from a natural gas prior to liquefying the natural gas using an open-loop natural gas refrigeration cycle. The disclosed methods and systems and units provide various benefits related to improved efficiency, reduced capital cost, reduced footprint and/or improved mechanical design, as will be described in greater detail below with reference to FIGS. 1 to 3.

As used herein and unless otherwise indicated, the articles "a" and "an" mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Where letters are used herein to identify recited steps of a method (e.g. (a), (b), and (c)), these letters are used solely to aid in referring to the method steps and are not intended to indicate a specific order in which claimed steps are performed, unless and only to the extent that such order is specifically recited.

Where used herein to identify recited features of a method or system, the terms "first", "second", "third" and so on, are used solely to aid in referring to and distinguishing between the features in question, and are not intended to indicate any specific order of the features, unless only to the extent that such order is specifically recited.

As used herein, the terms "natural gas" and "natural gas stream" encompass also gases and streams comprising synthetic and/or substitute natural gases. The major component of natural gas is methane (which typically comprises at least 85 mole %, more often at least 90 mole %, and on average about 95 mole % of the feed stream). Other typical components of raw natural gas that may be present in smaller amounts include one or more "light components" (i.e. components having a lower boiling point than methane) such as nitrogen, helium, and hydrogen, and/or one or more "heavy components" (i.e. components having a higher boiling point than methane) such as carbon dioxide and other acid gases, moisture, mercury, and heavier hydrocarbons such as ethane, propane, butanes, pentanes, etc. However, prior to being liquefied the raw natural gas feed stream will be treated (also referred to herein as "conditioning" the natural gas) if and as necessary in order to reduce the levels of any heavy components that may be present down to such levels as are needed to avoid freezing or other operational problems in the heat exchanger section or sections in which the natural gas is to be cooled and liquefied. A natural gas stream feed stream that has been treated so that it is "depleted in heavy components" has a reduced content of heavy components as compared to the initial untreated natural gas feed stream. Similarly, a liquid that is "enriched in heavy components", and that is produced as a result of treating the natural gas feed stream to remove heavy components therefrom, has an increased content of heavy components as compared to the initial untreated natural gas feed stream.

As used herein, the term "refrigeration cycle" refers a series of steps that a circulating refrigerant undergoes in order to provide refrigeration to another fluid. In an "open-loop refrigeration cycle" the feed stream comprising the fluid that is to be cooled/liquefied provides not only the liquefaction feed, but also the circulating refrigerant. For example, in an "open-loop natural gas refrigeration cycle" a first part of the natural gas feed stream is cooled and liquefied to form an LNG product, while a second part is used as a refrigerant and is then recycled back into the natural gas feed stream (which typically involves expanding and cooling the second part to form a cold refrigerant, warming said refrigerant via indirect heat exchange with the first part to providing the cooling duty for cooling and/or liquefying the first part, and then recycling the warmed refrigerant back into the feed stream). Conversely, in a "closed-loop refrigerant cycle" the refrigerant circulates in a closed-loop circuit and does not mix during ordinary circulation with the fluid that is to be cooled/liquefied (although if the refrigerant has the same composition as that of the fluid that is to be cooled/liquefied, or contains the same ingredients, the fluid feed stream may initially be used to fill the closed-loop circuit and/or may be used to periodically top-up the circuit to take account of leakage or other operational losses).

As used herein, the term "fluid flow communication" indicates that the devices or components in question are connected to each other in such a way that the stream(s) that are referred to can be sent and received by the devices or components in question. The devices or components may, for example, be connected by suitable tubes, passages or other forms of conduit for transferring the stream(s) in question, and they may also be coupled together via other components of the system that may separate them, such as for example via one or more valves, gates, or other devices that may selectively restrict or direct fluid flow.

As used herein, the term "expansion device" refers to any device or collection of devices suitable for expanding and thereby lowering the pressure of a fluid. Suitable types of expansion device for expanding a fluid include "isentropic" expansion devices, such turbo-expanders or hydraulic turbines, in which the fluid is expanded and the pressure and temperature of the fluid thereby lowered in a substantially isentropic manner (i.e. in a manner that generates works); and "isenthalpic" expansion devices, such as valves or other throttling devices, in which the fluid is expanded and the pressure and temperature of the fluid thereby lowered without the generating work.

As used herein, the term "flashing" (also referred to in the art as "flash evaporating") refers to the process of reducing the pressure of a liquid stream or two-phase stream (i.e. a stream containing both vapor and liquid) so as to partially vaporize the stream. The vapor present in the flashed stream is referred to herein as the "flash gas".

As used herein, the term "indirect heat exchange" refers to heat exchange between two fluids where the two fluids are kept separate from each other by some form of physical barrier.

As used herein, the term "heat exchanger section" refers to a unit or a part of a unit in which indirect heat exchange is taking place between one or more streams of fluid flowing through the cold side of the heat exchanger section and one or more streams of fluid flowing through the warm side of the heat exchanger section, the stream(s) of fluid flowing through the cold side being thereby warmed, and the stream(s) of fluid flowing the warm side being thereby cooled. The term "warm side", as used herein to refer to part of a heat exchanger section, refers to the side of the heat exchanger through which the stream or streams of fluid pass that are to be cooled by indirect heat exchange with the fluid flowing through the cold side. The term "cold side", as used herein to refer to part of a heat exchanger section, refers to the side of the heat exchanger through which the stream or streams of fluid pass that are to be warmed by indirect heat exchange with the fluid flowing through the warm side. Unless otherwise indicated, the heat exchanger section may a heat exchanger of any suitable type, such as but not limited to the shell and tube, coil wound, or plate and fin types of heat exchanger.

As used herein, the term "coil wound heat exchanger" refers to a heat exchanger of the type known in the art, comprising one or more tube bundles encased in a shell casing, wherein each tube bundle may have its own shell casing, or wherein two or more tube bundles may share a common shell casing. A "coil wound heat exchanger section" may comprise one or more tube bundles, the tube side of the bundle or bundles (the interior of the tubes in the bundle(s)) typically representing the warm side of said section and defining one or more than one passage through the section, and the shell side of the bundle or bundles (the space between and defined by the interior of the shell casing and exterior of the tubes) typically representing the cold side of said section and defining a single passage through the section. Coil wound heat exchangers are a compact design of heat exchanger known for their robustness, safety, and heat transfer efficiency, and thus have the benefit of providing highly efficient levels of heat exchange relative to their footprint. However, because the shell side defines only a single passage through the heat exchanger section it is not possible use more than one stream of refrigerant in the shell side of the coil wound heat exchanger section without said streams of refrigerant mixing in the shell side of said heat exchanger section.

As used herein, the term "separation section" refers to a refers to a unit or a part of a unit in which separation of the vapor and liquid fractions of a two-phase stream or mixture (a stream or mixture containing both liquid and vapor) is taking place. The separation section can simply be an open area or a vessel or shell casing defining a sump zone at the bottom of the section for collection of liquid and a head space zone above the sump zone for collection of vapor gas. Alternatively, the separation section can comprise one or more mass transfer devices for bringing downward flowing fluid into contact with upward rising vapor and thus enhancing mass transfer between the upward rising vapor and downward flowing liquid inside the section. The one of more mass transfer devices can of any suitable type known in the art, such as, for example, random packing, structured packing, and/or one or more plates or trays.

As used herein, the term "distillation column" refers to a column comprising one or more separation sections, each separation section containing one or more mass transfer devices (such as, for example, random packing, structured packing, and/or one or more plates or trays) for bringing downward flowing fluid into contact with upward rising vapor and thus enhancing mass transfer between the upward rising vapor and downward flowing liquid flowing through the section inside the column. In this way, the concentration of lighter components is increased in the overhead vapor, and the concentration of heavier components is increased in the bottoms liquid. The term "overhead vapor" refers in this context to the vapor that collects at the top of the column. The term "bottoms liquid" refers in this context to the liquid that collects at the bottom of the column. The "top" of the column refers to the part of the column above the separation sections. The "bottom" of the column refers to the part of the column below the separation sections. An "intermediate location" of the column refers to a location between the top and bottom of the column, between two separation sections. The term "reflux" refers to a source of downward flowing liquid from the top of the column. The term "boilup" refers to a source of upward rising vapor from the bottom of the column.

As used herein, the term "knock-out" drum (also referred to in the art as a flash drum or vapor-liquid separator) refers to vessel having an open area defining a sump zone at the bottom of the vessel for collection of liquid and a head space zone above the sump zone for collection of vapor gas. The vapor that collects at the top of the vessel is again referred to as the "overhead vapor", and the liquid that collects at the bottom of the vessel is again referred to herein as the ""bottoms liquid".

As used herein, the term "mist eliminator" refers to a device for removing entrained droplets or mist from a vapor stream. The mist eliminator can be any suitable device known in the art, including but not limited to a mesh pad eliminator or a vane type mist eliminator.

Referring now to FIG. 1, a natural gas liquefaction method and system in accordance with one embodiment of the present invention is shown, which method and system uses an open-loop natural gas refrigeration cycle to liquefy the natural gas and produce a liquefied natural gas (LNG) product.

A stream of recycled gas 104 is compressed in the first stage 100 of a compression train, comprising compression stages 100, 106, 108 and 110, each of which may represent an individual compressor or one or more stages of a multi stage compressor. Thus, for example, compression stage 100 may be a standalone compressor (having one or more stages) or it may be one or more lower pressure stages of a multi stage compressor that includes compressor stage 106 as one or more higher pressure stages. The compression train may also, as shown, incorporate one or more inter-stage coolers 107 for cooling the compressed gas between compression stages via indirect heat exchange with one or more ambient temperature fluids, such as air or water. Some of the compression stages (such as for example compression stages 108 and 110 as illustrated in FIG. 1) may be driven by direct coupling to an expander in the form of a "compander" device, while others may be driven by electric motors or gas turbines.

The stream of recycled gas 105 exiting the first compression stage 100 is combined with a natural gas feed stream 102 to form a combined feed stream 103, and the combined feed stream is then further compressed in the further compression stages 106, 108 and 110 of the compression train, typically to a pressure or 150 bara or above, and more preferably to a pressure of 200 bara or above, thereby forming a high pressure combined feed stream 114. As shown in FIG. 1, a small fuel stream 112 (typically having a mass flow rate of less than 10% of the mass flow rate of the natural gas feed stream 102) may also if desired be withdrawn from the combined feed stream at an intermediate location of the compression train. Preferably, the high pressure combined feed stream 114 exiting the final compression stage 110 is cooled in an after-cooler 116 via indirect heat exchange with one or more ambient temperature fluids, such as air or water, so as to form a high pressure combined feed stream 118 that is at or about ambient temperature.

It should be noted that although in FIG. 1 the natural gas feed stream is shown as being combined with the stream of recycled gas 105 between compression stages 100 and 106 of the compression train, the natural gas feed stream may alternatively be combined with the stream of recycled gas before or after any of the compression stages 100, 106, 108, 110, depending on the starting pressure of the natural gas feed stream (i.e. the pressure at which the natural gas feed stream is received by the system). Thus, the natural gas feed stream could for example be combined with the stream of recycled gas 104 before any compression of the stream of recycled gas takes place and with the resulting combined feed stream being compressed in each of the stages 100, 106, 108, 110 of the compression train; or the natural gas feed stream could be combined with the stream of recycled gas between two of the later (higher pressure) compression stages, such as between stages 106 and 108; or the natural gas feed stream could be combined with a fully compressed stream of recycled gas exiting the final compression stage 110 to from the high pressure combined feed stream 114, with no compression of the natural gas feed stream itself taking place.

The high pressure combined feed stream 118 is expanded in a first expansion device 119, and more preferably is expanded substantially isentropically in an isentropic expansion device such as for example turbo-expander 119, so as to cool the stream, preferably to a temperature below 0° C., more preferably to a temperature of −20 to −40° C., and most preferably to a temperature of about −30° C., thereby forming a cooled combined feed stream 120. The pressure of the cooled combined feed stream 120 will depend on the pressure and temperature of the high pressure combined feed stream 118 prior to expansion and the resulting expansion ratio (i.e. the ratio of pressure of the stream after expansion to the pressure before expansion began) needed in order to create the desired level of cooling, but may for example be about 90 bara. The work generated by isentropic expansion of the high pressure combined feed stream 118 may be put to any suitable use, but in a preferred embodiment may be used to drive one or more of the compression stages of the compression train, such as where the first expansion device 119 is a turbo-expander that is directly coupled to and drives compression stage 110, as illustrated in FIG. 1.

The cooled combined feed stream 120 is then divided into at least three parts, thereby forming at least a first feed stream 122, a second feed stream 127 and a third feed stream 146, all at the same pressure and temperature as the cooled combined feed stream. In the particular embodiment illustrated in FIG. 1, the combined feed stream 120 is divided into four parts, resulting in the formation also of a fourth feed stream 154, but the production of such additional feed streams is optional.

The first feed stream 122 is the second largest stream (i.e. has the second largest mass flow rate) out of the streams into which the cooled combined feed stream 120 is divided. Typically, the mass flow rate of the first feed stream 122 is from 20 to 30%, and more preferably is about 25%, of the mass flow rate of the cooled combined feed stream 120. The first feed stream 122 is further cooled and condensed by indirect heat exchange with a gaseous refrigerant stream 134 in a first heat exchanger section 124, the first feed stream 122 being cooled and condensed to form a first LNG stream 126, and the gaseous refrigerant stream 134 being warmed to form a stream of warmed gaseous refrigerant that forms the stream of recycled gas 138, 104 that, as described supra, is compressed and combined with the natural gas feed stream 102. The temperature of the first LNG stream 126 exiting the first heat exchanger section 124 will typically be at or close to (but slightly warmer than) the temperature of the gaseous refrigerant stream 134 entering the first heat exchanger section 124. In a preferred embodiment, the temperature of the first LNG stream 126 may be about −120° C. The first heat exchanger section 124 may be a heat exchanger section of any type, such as for example a plate and fin, shell and tube or coil-wound type, but is most preferably a heat exchanger section of the coil wound type, as is illustrated in FIG. 1, with the first feed stream 122 being passed through and further cooled and condensed in the tube side of the coil-wound heat exchanger section and with the gaseous refrigerant stream 134 being passed through and warmed in the shell side of the coil-wound heat exchanger section.

The second feed stream 127 is the largest stream (i.e. has the largest mass flow rate) out of the streams into which the cooled combined feed stream 120 is divided. Typically, the mass flow rate of the second feed stream 127 is from 65 to 75%, and more preferably is about 70%, of the mass flow rate of the cooled combined feed stream 120. The second feed stream 127 is further expanded in a second expansion device 128, and more preferably is further expanded substantially isentropically in an isentropic expansion device such as for example turbo-expander 128, so as to further cool the stream, preferably to a temperature of −110 to −140° C., and most preferably to a temperature of about −125° C., thereby forming a further expanded and cooled second feed stream 130 that is two-phase (i.e. that has both a liquid and a vapor fraction). The proportion of the further expanded and cooled second feed stream 130 that is liquid and the proportion that is vapor will depend on the pressure and temperature of the second feed stream 127 prior to expansion and the expansion ratio, but is preferably such that the vapor fraction of the further expanded and cooled second feed stream constitutes the majority of, and more preferably from 75 to 95 mole % of the further expanded and cooled second feed stream (the liquid fraction therefore preferably constituting a minority of, and more preferably from 5 to 25 mole % of the stream). The pressure of the further expanded and cooled second feed stream 130 will likewise depend on the pressure and temperature of the high pressure combined feed stream 118 prior to expansion and the resulting expansion ratio needed in order to create the desired level of cooling and produce the desired vapor to liquid ratio, but may for example be about 9 bara. The work generated by isentropic expansion of the second feed stream 127 may be put to any suitable use, but in a preferred embodiment may be used to drive one or more of the compression stages of the compression train, such as where the second expansion device 128 is a turbo-expander that is directly coupled to and drives compression stage 108, as illustrated in FIG. 1.

The further expanded and cooled second feed stream 130 is then introduced into a first separation section 132 in which the liquid and vapor fractions of the stream are separated, with the vapor fraction forming the gaseous refrigerant stream 134 that is then warmed in the first heat exchanger section 124 to provide the cooling duty for further cooling and condensing the first feed stream 122, as described supra, and with the liquid fraction forming a second LNG stream 136. In a preferred embodiment, the first separation section 132 is integrated with the first heat exchanger section 124 within the shell casing of a single unit, with the first separation section 132 being located above the first heat exchanger section 124, as is illustrated in FIG. 1 and as will be further described below with reference to FIG. 2. In other embodiments the first separation section may be integrated with the first heat exchanger section within the shell casing of a single unit, but with the separation section being located below the heat exchanger section, such as for example where a combined heat exchanger and separator unit as described in US2019/0346203A1 is used, the contents of which are incorporated herein in their entirety. In yet other embodiments, the first separation section and first heat exchanger section may constitute separate units, connected via suitable piping.

The third feed stream 146 and, where present, the fourth feed stream 154 are the smallest streams (i.e. have the smallest mass flow rates) out of the streams into which the cooled combined feed stream 120 is divided. Typically, the mass flow rate of the third feed stream 146 is only 1 to 5% of the mass flow rate of the cooled combined feed stream 120. Likewise, the mass flow rate of the fourth feed stream 154, where present, is typically only 1 to 5% of the mass flow rate of the cooled combined feed stream 120.

The third feed stream 146 is further cooled and condensed by indirect heat exchange with a first flash gas stream 150 in a second heat exchanger section 142, the third feed stream 146 being further cooled and condensed to form a third LNG stream 148, and the first flash gas stream 150 being warmed to form a warmed first flash gas stream 152. The temperature of third LNG stream 148 exiting the second heat exchanger section 142 is preferably lower than the temperature of the first LNG stream 126, and may for example be about −140° C. As with the first heat exchanger section 124, the second heat exchanger section 142 may be a heat exchanger section of any type, but is most preferably a heat exchanger section of the coil wound type as is illustrated in FIG. 1, with the third feed stream 146 being passed through and further cooled and condensed in the tube side of the coil-wound heat exchanger section and with the first flash gas stream 150 being passed through and warmed in the shell side of the coil-wound heat exchanger section.

The first LNG stream 126, second LNG stream 136 and third LNG stream 148 are then flashed in a third expansion device of set of expansion devices 141, 143 down to pressure below the discharge pressure of the second expansion device 128 (and above atmospheric pressure), such as for example down to a pressure of about 4 bara, such that each stream has liquid and vapor fractions, and the liquid and vapor fractions are then separated in a second separation section 140 or set of separation sections, with the liquid fractions forming a first LNG product stream 144, and with the vapor factions forming the first flash gas stream 150 that is then warmed in the second heat exchanger section 142 as described supra.

In the arrangement shown in FIG. 1, separate expansion devices 141, 143 are used to flash each of the first, second and third LNG streams separately, the first LNG stream 126 being flashed using an isentropic expansion device such as for example a dense fluid expander or hydraulic turbine 143 (or a hydraulic turbine followed by a valve), and the second and third LNG streams 136 and 148 being flashed using isenthalpic expansion devices such as valves 141, and the streams are then mixed and introduced as a single stream 145 into a single separation section 140 in which the liquid and vapor fractions of all of the streams are collected and separated. In the arrangement shown in FIG. 1, the second separation section 140 is also integrated with the second heat exchanger section 124 within the shell casing of a single unit, with the separation section being located below the heat exchanger section (and being for example an empty section the shell casing defining a sump zone at the bottom of the section for collection of the liquid fraction and a head space zone above the sump zone for collection of the vapor fraction), such as for example where a combined heat exchanger and separator unit as described in US2019/0346203A1 is used. However, other arrangements could instead be used. The second separation section could be integrated with the second heat exchanger section within the shell casing of a single unit, but with the second separation section being located above the second heat exchanger section (using a unit as will be further described below with reference to FIG. 2), or alternatively the second separation section and second heat exchanger section could constitute separate units, connected via suitable piping. Any form or combination of isentropic expansion devices and isenthalphic expansion devices may be used for flashing the first, second and third LNG streams. The first, second and third LNG streams could be combined before being flashed, with the combined stream then being flashed and introduced into the second separation section. Alternatively, separate expansion devices could be used to flash each of the first, second and third LNG streams separately, and separate separation sections could then be used to receive each of the flashed streams and separate the liquid and vapor fractions of each stream, with the separated liquid fractions then being combined and the separated vapor fractions then being combined (such an arrangement also alternatively allowing for the first flash gas stream to be formed only from the vapor fractions of only one or two of the first, second and third LNG streams and/or for the first LNG product stream to be formed from only one or two of the first, second and third LNG streams).

The fourth feed stream 154, where present, may be further cooled and condensed by indirect heat exchange with a second flash gas stream 164 in a third heat exchanger section 156, the fourth feed stream 154 being further cooled and condensed to form a fourth LNG stream 158, and the second flash gas stream 164 being warmed to form a warmed second flash gas stream 166. The temperature of fourth LNG stream 158 exiting the third heat exchanger section 156 is preferably lower than the temperature of the third LNG stream 148, and may for example be about −150° C. As with the first and second heat exchanger sections, the third heat exchanger section 156 may be a heat exchanger section of any type, but is most preferably a heat exchanger section of the coil wound type as is illustrated in FIG. 1, with the fourth feed stream 154 being passed through and further cooled and condensed in the tube side of the coil-wound heat exchanger section and with the second flash gas stream 164 being passed through and warmed in the shell side of the coil-wound heat exchanger section.

Where, as described above, a fourth LNG stream 158 is generated, the fourth LNG stream 158 and the first LNG product stream 144 may then flashed in a fourth expansion device of set of expansion devices 161 down to pressure below the discharge pressure of the third expansion device or set of expansion devices 141, 143 (and at or above atmospheric pressure), such as for example down to a pressure of 1 to 1.5 bara, such that each stream has liquid and vapor fractions, and the liquid and vapor fractions are then separated in a third separation section 160 or set of separation sections, with the liquid fractions forming a second LNG product stream 162, and with the vapor factions forming the second flash gas stream 160 that is then warmed in the third heat exchanger section 156 as described supra.

In the arrangement shown in FIG. 1, separate expansion devices 161 are used to flash the fourth LNG stream 158 and first LNG product stream 144 separately, both of said streams 158 and 144 being flashed using isenthalphic expansion devices such as valves 161, and the streams are then mixed and introduced as a single stream 165 into a single separation section 160 in which the liquid and vapor fractions of both the streams are collected and separated. In the arrangement shown in FIG. 1, the third separation section 160 is also integrated with the third heat exchanger section 156 within the shell casing of a single unit, with the separation section being located below the heat exchanger section (and being for example an empty section of the shell casing defining a sump zone at the bottom of the section for collection of the liquid fraction and a head space zone above the sump zone for collection of the vapor fraction), such as for example where a combined heat exchanger and separator unit as described in US2019/0346203A1 is used. Again, however, other arrangements could instead be used. The third separation section could be integrated with the third heat exchanger section within the shell casing of a single unit, but with the third separation section being located above the third heat exchanger section (using a unit as will be further described below with reference to FIG. 2), or alternatively the third separation section and third heat exchanger section could constitute separate units, connected via suitable piping. Any form or combination of isentropic expansion devices and isenthalphic expansion devices may be used for flashing the fourth LNG stream and first LNG product stream. The fourth LNG stream and first LNG product stream could be combined before being flashed, with the combined stream then being flashed and introduced into the third separation section. Alternatively, separate expansion devices could be used to flash each of the fourth LNG stream and first LNG product stream separately, and separate separation sections could then be used to receive each of the flashed streams and separate the liquid and vapor fractions of each stream, with the separated liquid fractions then being combined and the separated vapor fractions then being combined.

Finally, the warmed first flash gas stream 152 and, where present, the warmed second flash gas stream 166 may also be recycled as one or more additional streams of recycled gas that are combined with the natural gas feed stream. In the particular arrangement shown in FIG. 1, the first flash gas stream 152 and the second flash gas stream are combined and compressed in a multi-stage compressor 168, and are preferably cooled in an after-cooler 170 via indirect heat exchange with one or more ambient temperature fluids such as air or water, so as to form an additional stream of recycled gas 172 (although separate compressors could equally be used to compress the flash gas streams separately, with the compressed streams then being combined or otherwise forming two separate streams of recycled gas). Where the additional stream of recycled gas 172 is at the same pressure as the stream of recycled gas 138 withdrawn from the first heat exchanger section 124, the two streams may as shown in FIG. 1 be combined to form a single stream of recycled gas 104 that is then compressed in the first stage 100 of the compression train. Alternatively, where the additional stream of recycled gas 172 is at a different pressure from the pressure of the stream of recycled gas 138 withdrawn from the first heat exchanger section 124, the two streams may be introduced into the compression train at different locations. For example, where the additional stream of recycled gas 172 is at a higher pressure than the stream of recycled gas 138, the additional stream of recycled gas 172 could be combined with the stream of recycled gas 138 and natural gas feed stream 102 by being introduced into the compression train between two of the compression stages 100, 106, 108, 110 or even after the last compression stage 110, depending on the pressure of the additional stream of recycled gas 172.

The natural gas liquefaction method and system depicted in FIG. 1 and described above provides a number of benefits.

First, by compressing the recycled gas and, as necessary, the natural gas feed stream to a very high pressure to form a high pressure combined feed stream 114, 118 at a pressure of, typically, 150 bara or above, and more preferably 200 bara or above, it is possible to achieve high expansion ratios and large pressure drops across both the first expansion device 119 and the second expansion device 128, thereby producing significant amounts of cooling both when expanding the high pressure combined feed stream 118 to produce the cooled combined feed stream 120 and when expanding the second feed stream 127 to produce the further expanded and cooled second feed stream 130. This, in turn, allows the first feed stream 122 and the further expanded and cooled second feed stream 130 to be produced at low temperatures that remove the need for any precooling of these streams in any additional heat exchanger sections prior to the first feed stream 122 being introduced into and further cooled in the first heat exchanger section 124 and prior to the further expanded and cooled second feed stream 130 being separated to provide the gaseous refrigerant stream 134 that provides the cooling duty to the first heat exchanger section 124. By removing the need for any such additional heat exchangers (which would have to be sized appropriately to accommodate the significant mass flow rates of the first feed stream 122 and the further expanded and cooled second feed stream 130), the capital cost and footprint of the liquefaction facility can be reduced.

Second, by separating the further expanded and cooled second feed stream 130 in the first separation section 132 into its liquid and vapor fractions, forming the gaseous refrigerant stream 134 from said vapor fraction, and then using only said gaseous refrigerant stream 134 (and not any of the separated liquid fraction) as refrigerant in the first heat exchanger section 124, the use of a two-phase refrigerant stream in the first heat exchanger section 124 is avoided. Using instead a two-phase refrigerant stream in the first heat exchanger section 124 for providing the cooling duty for further cooling and condensing the first feed stream would decrease the efficiency of the process and system, because the boiling of liquid in the cold end of the first heat exchanger section would increase the temperature difference in the exchanger, creating exergy losses. Simulations carried out by the present inventors have shown that that by separating the further expanded and cooled second feed stream 130 in the first separation section 132 into its liquid and vapor fractions, and using only the vapor fraction as the refrigerant in the first heat exchanger section, the power requirement of the process is decreased by 4%, even for a relatively lean natural gas feed stream where the liquid fraction of the further expanded and cooled second feed stream represents only 14 mole % of said stream.

Third, because the first heat exchanger section 124, second heat exchanger section 142, and (where present) third heat exchanger section 156 all use only a single stream of refrigerant to provide the required cooling duty (i.e. the gaseous refrigerant stream 134 in the case of the first heat exchanger section 124, the first flash gas stream 150 in the case of the second heat exchanger section 142, and the second flash gas stream 164 in the case of the third heat exchanger section 156), it is possible to use coil wound heat exchanger sections for each of these heat exchanger sections, thereby allowing the benefits (i.e. compactness and high efficiency) of using this type of exchanger to be obtained.

Figure 2:
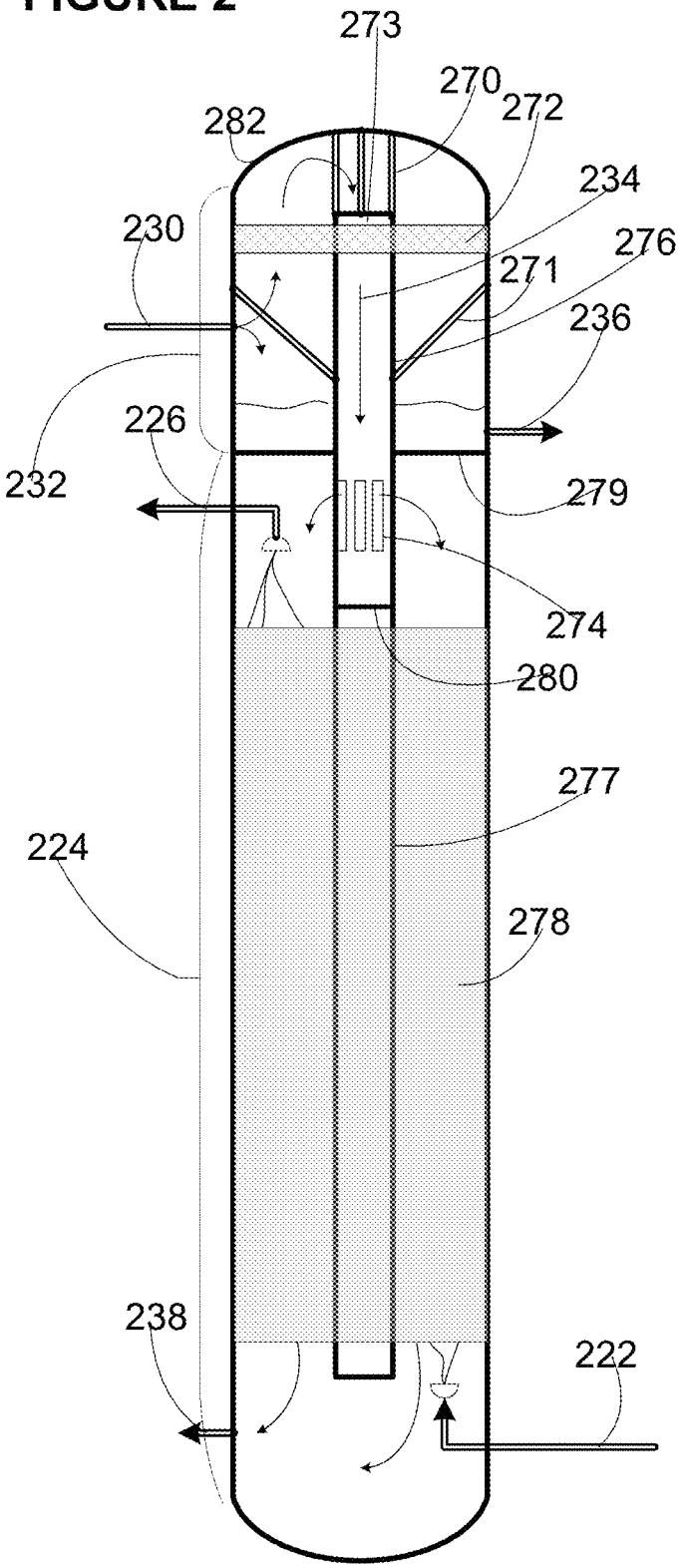
FIG. 2 is a schematic flow diagram depicting a coil wound heat exchanger unit for cooling one or more feed streams via indirect heat exchange with a gaseous refrigerant.

Referring now to FIG. 2, a coil wound heat exchanger unit in accordance with another embodiment of the invention is shown, which coil wound heat exchanger unit is used for cooling one or more feed streams via indirect heat exchange with a gaseous refrigerant stream that is formed from the vapor fraction of a two phase stream that is separated by the unit. As described above, the coil wound heat exchanger unit of this embodiment may, for example, advantageously be used as the first separation section 132 and first heat exchanger section 124 of the system shown in FIG. 1, with the feed stream that is cooled by the coil wound heat exchanger unit being the first feed stream 122 of FIG. 1, and with two phase stream and gaseous refrigerant stream that that are used by the unit being, respectively, the further expanded and cooled second feed stream 130 and the gaseous refrigerant stream 134 of FIG. 1. However, the coil wound heat exchanger unit may equally be used to cool any other type of feed stream via indirect heat exchanger with a gaseous refrigerant stream formed from the vapor fraction of any other type of two phase stream. For example, and as also descried above, the coil wound heat exchanger unit could be used as the second separation section 140 and second heat exchanger section 142 or as the third separation section 160 and third heat exchanger section 156 of the system shown in FIG. 1, with the feed stream, two-phase stream and gaseous refrigerant stream being respectively streams 146, 145 and 150 or 154, 165 and 164. Equally, the coil wound heat exchanger unit could be used to cool any other type of natural gas feed stream, using any type of two phase stream and gaseous refrigerant stream, such as, but not limited to, a two phase stream and gaseous refrigerant stream that are themselves derived from the natural gas feed stream.

The coil wound heat exchanger unit comprises a shell casing (vessel shell) 282 enclosing a heat exchanger section 224, a separation section 232 located above the heat exchanger section 224, a partition 279 separating the heat exchanger section 224 from the separation section 232, and one or more conduits 276 between the heat exchanger 224 section and separation section 232 extending through the partition 279.

The heat exchanger section is a coil wound heat exchanger section 224 comprising at least one coil wound tube bundle (depicted schematically in FIG. 2 as shaded section 278) defining a tube side and a shell side of the heat exchanger section, the tube side defining one or more passages through the heat exchanger section for cooling the one or more feed streams 222 (such as for example the first feed stream 122 of FIG. 1) to form one or more cooled feed streams 226 (such as for example the first LNG stream 126 of FIG. 1), and the shell side defining a passage through the heat exchanger section for warming the gaseous refrigerant stream 234 (such as stream 134 of FIG. 1) to form a stream of warmed gaseous refrigerant 238 (such as stream 138 of FIG. 1). The one or more feed streams 222 are introduced into the tube side of the heat exchanger section, preferably at the bottom of the heat exchanger section, via a first inlet or set of inlets of the shell casing that are in fluid flow communication with the tube side of the heat exchanger section; and the one or more cooled feed streams 226 are withdrawn from the tube side of the heat exchanger section, preferably at the top of the heat exchanger section, and from the coil wound heat exchanger unit as a whole, via a first outlet or set of outlets of the shell casing that are in fluid flow communication with the tube side of the heat exchanger section. In theory the coil wound heat exchanger unit and heat exchanger section 224 could also be operated with a gaseous stream 234 that requires cooling and with a feed stream 222 that acts as refrigerant, with the gaseous stream 234 being passed through the shell side of the heat exchanger section to be cooled and with the feed stream 222 being passed through the tube side to be warmed—however, such an arrangement would be highly inefficient in practice.

The separation section 232 is configured to receive a two phase stream 230 (such as for example the further expanded and cooled second feed stream 130 of FIG. 1), and to separate the liquid and vapor fractions of said stream, with the liquid fraction collecting at the bottom of the separation section and the vapor fraction collecting at the top of the separation section. The vapor fraction of the two phase stream 230 may for example constitute anything from 2 to 98 mole % of the two phase stream 230, but for most applications the vapor fraction will constitute the majority of the two phase stream, and preferably the vapor fraction will constitute 75 to 98 mole %, and more preferably 75 to 95 mole % or 80 to 98 mole % or 80 to 95 mole % of the two-phase stream (with the liquid fraction therefore constituting a minority of, and preferably 2 to 25 mole %, and more preferably 5 to 25 mole % or 2 to 20 mole % or 5 to 20 mole % of the two phase stream). The two phase stream 230 is introduced into the separation section 232 via a second inlet of the shell casing that is in fluid flow communication with the separation section 232. The shell casing also has a second outlet that is in fluid flow communication with the separation section for withdrawing a stream of the liquid 236 collecting at the bottom of the separation section.

The partition 279, which may for example take the form of a bulkhead plate, and the one or more conduits 276 are configured so as to prevent flow of fluid between the separation section 232 and heat exchanger section 224 other than through the one or more conduits 276. The partition 279 and the second outlet of the shell casing are also located and configured such that, in ordinary operation of the coil wound heat exchanger unit, the level of the liquid that collects at the bottom of the separation section is above the location of the second outlet of the shell casing, so that only liquid (and no vapor) can exit the separation section via the second outlet. The one or more conduits 276 each have an inlet 273 located above the partition 224 towards the top of the separation section and an outlet 274 located below the partition 224 towards the top of the heat exchanger section on the shell side of the heat exchanger section, whereby liquid collecting at the bottom of the separation section cannot flow into the heat exchanger section, whereas vapor collecting at the top of the separation section can flow through the one or more conduits 276 and into the top of the shell side of the heat exchanger section, thereby forming the gaseous refrigerant stream 234 that then flows through and is warmed in the shell side of the heat exchanger section. The resulting stream of warmed gaseous refrigerant 238 is then withdrawn from the bottom of the shell side of the heat exchanger section, and from the coil wound heat exchanger unit as a whole, via a third outlet of the shell casing that is in fluid flow communication with the shell side of the heat exchange section.

The second inlet of the shell casing, via which the two phase stream 230 is introduced into the separation section 232, is preferably located so as to introduce the two phase stream into the separation section at a location below the location of the inlet(s) 273 to the conduit(s) 276 via which the gaseous refrigerant stream 234 flows from the separation section 232 into the heat exchanger section 224. To help prevent the flow of any liquid into the heat exchanger section, the coil wound heat exchanger unit may also further comprise a mist eliminator 272 located in the separation section 232 between the second inlet of the shell casing (via which the two phase stream 230 is introduced into the separation section 232) and the inlet(s) 273 to the conduit(s) 276, the mist eliminator being designed and configured ensure a high removal of any entrained liquid from the vapor that collects at the top of the separation section prior to said vapor entering the conduit 276 and forming the gaseous refrigerant stream 234.

In the arrangement shown in FIG. 2, the heat exchanger section further 224 further contains a mandrel 277 around which the tubes of the coil wound tube bundle are wound, which mandrel extends upwards through the partition 279, the upwards extension of the mandrel being hollow and forming the conduit 276 via which vapor collecting at the top of the separation section flows as the gaseous refrigerant stream 234 through and into the top of the shell side of the heat exchanger section. The top end of upwards extension of the mandrel is open, and this forms the inlet 273 to the conduit via which vapor at the top of the separation section enters the conduit 276 and forms the gaseous refrigerant stream 234. Below the partition 279, various circumferential slots or holes in the upwards extension of the mandrel form the outlet 274 via which the gaseous refrigerant stream 234 exits the conduit and enters the top of the shell side of the heat exchanger section. A seal plate 280 inside the mandrel below the outlet 274 prevents the gaseous refrigerant from passing further down the inside of the mandrel and thereby bypassing the shell side of the heat exchanger section. In the arrangement shown, the weight of the coil wound tube bundle is supported via support structures 270 that connect the top of the upward extension of the mandrel/conduit 276 to the vessel shell 282. Also shown in FIG. 2 is an additional or alternative support arrangement, suitable for larger, heavier bundles, which uses pinned support arms 271 between the mandrel and the shell.

In an alternative arrangement, not shown in FIG. 2, the conduit or conduits 276 which via which the gaseous refrigerant stream 234 flows from the separation section 232 into the heat exchanger section 224 may be separate from the mandrel that supports the coil wound tube bundle. In this arrangement the diameters of the mandrel and conduit may differ, and be sized as required for their respective functions, and multiple conduits may be used if desired in order to improve vapor distribution.

The benefits of a coil wound heat exchanger unit as depicted in FIG. 2 and described above, as compared to a combined heat exchanger and separator unit as described in US2019/0346203A1, are as follows.

For mechanical design and piping reasons it is often advantageous to arrange a coil wound heat exchanger section such that the shell side flow is downward across the coil wound bundle (i.e. such that the coil wound heat exchanger section is in a cold end up orientation in the case where a shell side refrigerant is used). The support structure in a coil wound heat exchanger bundle is designed to carry both the weight of the bundle and the pressure force due to the shell side flow when operating. For a heat exchanger unit with upward shell side flow, like the unit in US2019/0346203A1, the gravitational force is in the opposite direction from the pressure drop force and the support system must be designed to handle both. In shutdown or turndown conditions, the net force is in the downward direction, while in a high production condition the net force may be in an upward direction. This can present difficulties in the mechanical design of the exchanger as it requires the support to handle forces in both directions and because material fatigue may result if the switching of net force direction is frequent. Exchangers designed for downward shell side flow may also provide benefits in the layout of connecting piping to other equipment depending on the plant layout. Such problems are solved in the arrangement shown in FIG. 2 since it provides for downward shell side flow (i.e. flow of the gaseous refrigerant stream downwards through the shell side of the heat exchanger section), while still performing the same function as the unit disclosed and described in US2019/0346203 in terms of providing a single unit that separates a two phase stream and then uses the vapor fraction as a gaseous refrigerant in the shell side of a heat exchanger section (thereby providing for a more compact, cost-efficient, and smaller footprint arrangement than those systems that use separate separation vessels and heat exchangers).

Figure 3:
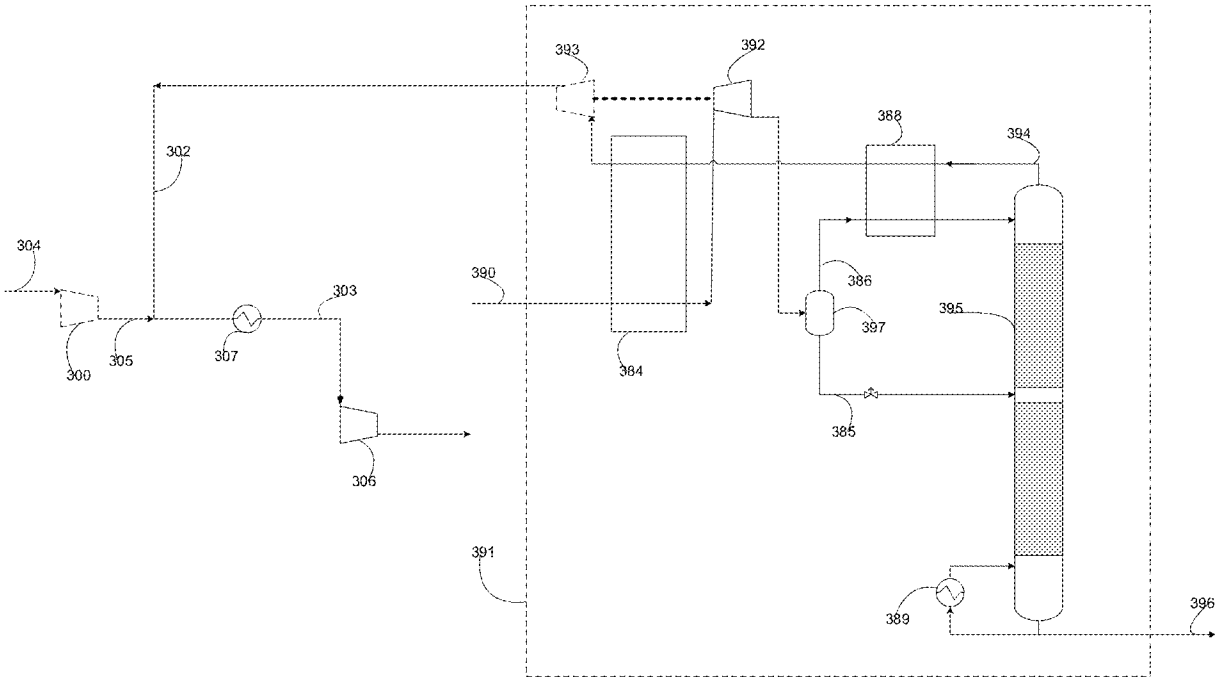
FIG. 3 is a schematic flow diagram depicting a method and system for removing heavy components from a natural gas prior to liquefying the natural gas using an open-loop natural gas refrigeration cycle.

Referring now to FIG. 3, a method and system in accordance with another embodiment of the invention is shown, for removing heavy components from a natural gas feed stream in order to prepare and condition the natural gas as necessary for subsequent liquefaction. The method and system can be used for removing heavy components prior to the natural gas being liquefied in any type of open loop natural gas refrigeration cycle, but in a preferred arrangement the method and system depicted in FIG. 3 is used for removing heavy components from a natural gas feed stream prior to liquefaction of the natural gas in a method and system as shown in FIG. 1 and described supra.

The heavy component containing natural gas feed stream 390 is treated in a heavy component removal system 391 that separates methane from heavier components based on liquid-vapor phase equilibria. A variety of such systems are known, but for the purposes of illustration a system 391 using the Ortloff GSP process is shown in FIG. 3. The natural gas feed stream 390 is preferably first cooled in economizer heat exchanger section 384, and is then is expanded in one or more expansion devices 392 in order to cool the stream, thereby forming a cooled natural gas feed stream 398. Preferably the expansion devices 392 comprise one or more isentropic expansion devices, such as for example one or more turbo-expanders 392, that expand the natural gas feed stream in a substantially isentropric manner, although isenthalpic expansion utilizing one or more valves or other such isenthalpic expansion devices can additionally or alternatively be used.

The cooled natural gas stream 398 is then separated in one or more separation devices 397, 395, such as for example one or more knock-out drums 397 and/or distillation columns 395, to form a gaseous natural gas feed stream 394 that is depleted in heavy components (and that retains most of the methane present in the original natural gas feed stream) and a liquid stream 395 that is enriched in heavy components. In the specific arrangement shown in FIG. 3, the cooled natural gas stream 398, which is two phase, is first separated in a knock out drum 398 into a liquid feed stream 385 and vapor feed stream 386. The liquid feed stream 385 is sent to an intermediate location of a distillation column 395. The vapor feed stream 386 is further cooled in an overhead heat exchanger section 388 and sent to the top of the distillation column to provide cooling and reflux to the top of the column. Boil-up for the distillation column is provided by a reboiler 389. The distillation column 395 separates the liquid and vapor feed streams 385, 385 into an overhead vapor, that forms the heavy component depleted gaseous natural gas feed stream 394, and a bottoms liquid, that forms the heavy component enriched liquid stream 395. The heavy component depleted gaseous natural gas feed stream 394 is then warmed in the overhead heat exchanger section 388 and, where present, further warmed in the economizer heat exchanger section 384, to provide a heavy component depleted gaseous natural gas feed stream 302 that is ready to be liquefied via an open-loop refrigeration cycle.

In the open-loop refrigeration cycle, the heavy component depleted gaseous natural gas feed stream 302 is then combined with one or more streams of recycled gas 304, said streams being combined at a pressure below the critical pressure of methane, and the resulting combined feed stream 303 is then compressed to form a high pressure combined stream (preferably having a pressure above the starting pressure of the heavy component containing natural gas feed stream 390), with a first portion of the high pressure combined feed stream being liquefied using a second portion of the high pressure combined feed stream as the refrigerant for providing the cooling duty for liquefying the first portion, the second portion (i.e. the refrigerant) once warmed forming one or more of the one or more streams of recycled gas. The one or more streams of recycled gas may also include one or more streams of (preferably warmed) flash gas in addition to the one or more streams of warmed refrigerant, although preferably more than 50 mole % and preferably more than 70 mole % of the gas in the recycled gas stream(s) is recycled warmed refrigerant. As shown in FIG. 3, the stream or streams of recycled gas 304 may optionally be compressed in one or more optional compression stages 300 prior to being combined with the heavy component depleted gaseous natural gas feed stream 302, depending on the relative pressures of the streams of recycled gas and the heavy component depleted gaseous natural gas feed stream. As noted above, any type of open-loop refrigeration cycle can be used, but in a preferred embodiment the method and system of FIG. 1 is used, wherein the heavy component depleted gaseous natural gas feed stream 302 corresponds to the natural gas feed stream 102 in FIG. 1, the stream of recycled gas 304 corresponds to the stream of recycled gas 104 in FIG. 1, and the compression stages 300 and 306 and intercooler 307 depicted in FIG. 3 correspond to the compression stages 100 and 106 and intercooler 107 in FIG. 1.

Where the one or more isentropic expansion devices 392 were used to expand the heavy component containing natural gas feed stream 390, one or more compression stages 393 driven by the work produced by said isentropic expansion device(s) 392 may be used to compress the heavy component depleted gaseous natural gas feed stream 394 prior to said stream 302 being combined with the one or more streams of recycled gas 304, such as for example is illustrated in FIG. 3 in which optional compressor 393 is driven by direct coupling to turbo-expander 392 in the form of a "compander" device. However, it should be noted that in the method and system of FIG. 3 the heavy component depleted gaseous natural gas feed stream 394, 304 is not subjected to any externally driven compression (i.e. any compression driven by power sources other than power generated from expanding the natural gas feed stream) prior to the heavy component depleted gaseous natural gas feed stream 394, 304 being combined with the one or more streams of recycled gas 304. It should also be noted that in the method and system of FIG. 3 the heavy component containing natural gas feed stream 390 is treated to remove heavying components, thereby forming the heavy component depleted gaseous natural gas feed stream 394, before being combined with any streams of recycled gas from the open-loop natural gas refrigeration cycle (such as stream 304).

A benefit of the method and system depicted in FIG. 3 is that no externally driven compression is used or required in order to prepare the natural gas feed stream for subsequent liquefaction. In to order efficiently remove heavy components from the natural gas feed stream it is typically necessary lower the pressure of the feed stream, so as to have a more favorable heavy to light component relative volatility for the separation of the heavy components, and in order to provide the refrigeration needed to cool the feed stream and remove the heavy components as liquid. Conversely, for efficient liquefaction of the feed stream it is typically necessary to compress the natural gas feed stream to a high pressure. However, in the embodiment shown in FIG. 3, the compressors in the compression train that is used for compressing the recycled gas in the open-loop refrigeration cycle are also used for recompressing the natural gas feed stream after removal of the heavy components from said feed stream, thereby avoiding the added expense of a separate, externally driven compressor and drive system for recompressing the natural gas feed stream after removal of the heavy components.

A further benefit of the method and system depicted in FIG. 3 is that the removal of heavy components from the natural gas feed stream is carried out prior to combining the natural gas feed stream with the recycled gas from the open-loop refrigeration cycle. Combining the recycled gas with the natural gas feed stream before removing heavy components from the natural gas feed stream would result in the concentration of heavy components in the natural gas feed stream being diluted prior to removal of the heavy components from the stream, which would make removal of the heavy components more difficult and which would thus would reduce the efficiency of the process.

EXAMPLE

The method and system as described and depicted in FIG. 1 was simulated, and the results of the simulation are presented below in Tables 1a and 1b. In these tables, the listed the stream numbers correspond to the reference numerals used in FIG. 1.

TABLE 1a

| Stream | 138 | 104 | 102 | 105 | 103 | 109 | 112 |
|---|---|---|---|---|---|---|---|
| Temperature ° C. | −32.9 | −24.7 | 25.0 | 85.3 | 27.0 | 71.5 | 27.0 |
| Pressure bara | 8.57 | 8.57 | 32.45 | 32.45 | 31.95 | 52.28 | 51.78 |
| Molar Vapor Fraction | 1.00 | 1.00 | 1.00 | 1.00 | 1.00 | 1.00 | 1.00 |
| Mole Flows kmol/hr | 26340 | 30487 | 13571 | 30486.62 | 44057.14 | 44057.14 | 492 |
| Mole Fractions | | | | | | | |
| N2 | 0.02544 | 0.03154 | 0.00330 | 0.03154 | 0.02274 | 0.02274 | 0.03154 |
| CD | 0.00001 | 0.00001 | 0.00005 | 0.00001 | 0.00002 | 0.00002 | 0.00001 |
| C1 | 0.97315 | 0.96723 | 0.95931 | 0.96723 | 0.96476 | 0.96476 | 0.96723 |
| C2 | 0.00137 | 0.00120 | 0.02500 | 0.00120 | 0.00861 | 0.00861 | 0.00120 |
| C3 | 0.00004 | 0.00003 | 0.00930 | 0.00003 | 0.00292 | 0.00292 | 0.00003 |
| I4 | 0.00000 | 0.00000 | 0.00150 | 0.00000 | 0.00047 | 0.00047 | 0.00000 |
| C4 | 0.00000 | 0.00000 | 0.00150 | 0.00000 | 0.00047 | 0.00047 | 0.00000 |
| I5 | 0.00000 | 0.00000 | 0.00002 | 0.00000 | 0.00001 | 0.00001 | 0.00000 |
| C5 | 0.00000 | 0.00000 | 0.00002 | 0.00000 | 0.00001 | 0.00001 | 0.00000 |

| Stream | 114 | 118 | 120 | 127 | 130 | 134 |
|---|---|---|---|---|---|---|
| Temperature ° C. | 69.3 | 27.0 | −29.5 | −29.5 | −124.6 | −124.8 |
| Pressure bara | 241.32 | 240.82 | 93.08 | 93.08 | 9.02 | 8.92 |
| Molar Vapor Fraction | 1.00 | 1.00 | 1.00 | 1.00 | 0.88 | 1.00 |
| Mole Flows kmol/hr | 43565 | 43565 | 43565 | 29924 | 29924 | 26340 |
| Mole Fractions | | | | | | |
| N2 | 0.02274 | 0.02274 | 0.02274 | 0.02274 | 0.02274 | 0.02544 |
| CD | 0.00002 | 0.00002 | 0.00002 | 0.00002 | 0.00002 | 0.00001 |
| C1 | 0.96476 | 0.96476 | 0.96476 | 0.96476 | 0.96476 | 0.97315 |
| C2 | 0.00861 | 0.00861 | 0.00861 | 0.00861 | 0.00861 | 0.00137 |
| C3 | 0.00292 | 0.00292 | 0.00292 | 0.00292 | 0.00292 | 0.00004 |
| I4 | 0.00047 | 0.00047 | 0.00047 | 0.00047 | 0.00047 | 0.00000 |
| C4 | 0.00047 | 0.00047 | 0.00047 | 0.00047 | 0.00047 | 0.00000 |
| I5 | 0.00001 | 0.00001 | 0.00001 | 0.00001 | 0.00001 | 0.00000 |
| C5 | 0.00001 | 0.00001 | 0.00001 | 0.00001 | 0.00001 | 0.00000 |

TABLE 1b

| Stream | 136 | 122 | 126 | 146 | 148 | 144 | 150 |
|---|---|---|---|---|---|---|---|
| Temperature ° C. | −124.8 | −29.5 | −121.8 | −29.5 | −139.7 | −142.7 | −142.7 |
| Pressure bara | 8.92 | 93.08 | 89.63 | 93.08 | 89.63 | 3.98 | 3.98 |
| Molar Vapor Fraction | 0.00 | 1.00 | 0.00 | 1.00 | 0.00 | 0.00 | 1.00 |
| Mole Flows | 3584 | 11803 | 11803 | 1073 | 1073 | 14030 | 2430 |

TABLE 1b-continued

| kmol/hr Mole Fractions | | | | | | | |
|---|---|---|---|---|---|---|---|
| N2 | 0.00292 | 0.02274 | 0.02274 | 0.02274 | 0.02274 | 0.00703 | 0.08422 |
| CD | 0.00011 | 0.00002 | 0.00002 | 0.00002 | 0.00002 | 0.00005 | 0.00000 |
| C1 | 0.90310 | 0.96476 | 0.96476 | 0.96476 | 0.96476 | 0.95752 | 0.91560 |
| C2 | 0.06187 | 0.00861 | 0.00861 | 0.00861 | 0.00861 | 0.02368 | 0.00018 |
| C3 | 0.02410 | 0.00292 | 0.00292 | 0.00292 | 0.00292 | 0.00884 | 0.00000 |
| I4 | 0.00390 | 0.00047 | 0.00047 | 0.00047 | 0.00047 | 0.00143 | 0.00000 |
| C4 | 0.00390 | 0.00047 | 0.00047 | 0.00047 | 0.00047 | 0.00143 | 0.00000 |
| I5 | 0.00005 | 0.00001 | 0.00001 | 0.00001 | 0.00001 | 0.00002 | 0.00000 |
| C5 | 0.00005 | 0.00001 | 0.00001 | 0.00001 | 0.00001 | 0.00002 | 0.00000 |
| Stream | 152 | 154 | 158 | 164 | 162 | 166 | 172 |
| Temperature ° C. | −32.8 | −29.5 | −156.1 | −159.1 | −159.1 | −32.6 | 27.0 |
| Pressure bara | 3.63 | 93.08 | 89.63 | 1.24 | 1.24 | 1.10 | 8.57 |
| Molar Vapor Fraction | 1.00 | 1.00 | 0.00 | 1.00 | 0.00 | 1.00 | 1.00 |
| Mole Flows kmol/hr | 2430 | 766 | 766 | 1717 | 13079 | 1717 | 4147 |
| Mole Fractions | | | | | | | |
| N2 | 0.08422 | 0.02274 | 0.02274 | 0.05052 | 0.00224 | 0.05052 | 0.07027 |
| CD | 0.00000 | 0.00002 | 0.00002 | 0.00000 | 0.00005 | 0.00000 | 0.00000 |
| C1 | 0.91560 | 0.96476 | 0.96476 | 0.94942 | 0.95901 | 0.94942 | 0.92960 |
| C2 | 0.00018 | 0.00861 | 0.00861 | 0.00006 | 0.02590 | 0.00006 | 0.00013 |
| C3 | 0.00000 | 0.00292 | 0.00292 | 0.00000 | 0.00965 | 0.00000 | 0.00000 |
| I4 | 0.00000 | 0.00047 | 0.00047 | 0.00000 | 0.00156 | 0.00000 | 0.00000 |
| C4 | 0.00000 | 0.00047 | 0.00047 | 0.00000 | 0.00156 | 0.00000 | 0.00000 |
| I5 | 0.00000 | 0.00001 | 0.00001 | 0.00000 | 0.00002 | 0.00000 | 0.00000 |
| C5 | 0.00000 | 0.00001 | 0.00001 | 0.00000 | 0.00002 | 0.00000 | 0.00000 |

It will be appreciated that the invention is not restricted to the details described above with reference to the preferred embodiments but that numerous modifications and variations can be made without departing from the spirit or scope of the invention as defined in the following claims.

The invention claimed is:

1. A method of liquefying natural gas using an open-loop natural gas refrigeration cycle, the method comprising the steps of:

(a) forming a high pressure combined feed stream by combining one or more streams of recycled gas with a natural gas feed stream to form a combined feed stream and compressing either the combined feed stream, or the one or more streams of recycled gas prior to combination with the natural gas feed stream, or both;

(b) expanding the high pressure combined feed stream to cool the stream, thereby forming a cooled combined feed stream;

(c) dividing the cooled combined feed stream into at least three separate streams, thereby forming a first feed stream, a second feed stream and a third feed stream;

(d) further cooling the first feed stream via indirect heat exchange with a gaseous refrigerant stream, the first feed stream being cooled to form a first LNG stream and the gaseous refrigerant stream being warmed to form a stream of warmed gaseous refrigerant that forms one of the one or more streams of recycled gas;

(e) further expanding the second feed stream to further cool said stream thereby forming a further expanded and cooled second feed stream that is two-phase, having liquid and vapor fractions, and separating said liquid and vapor fractions to form the gaseous refrigerant stream from the vapor fraction and a second LNG stream from the liquid fraction;

(f) further cooling the third feed stream, via indirect heat exchange with a first flash gas stream, to form a third LNG stream; and (g) flashing the first, second and third LNG streams such that each stream has liquid and vapor fractions, and separating said liquid and vapor fractions to form a first LNG product stream from the liquid fraction of one or more of said streams and the first flash gas stream from the vapor fraction of one or more of said streams.

2. A method as claimed in claim 1, wherein the high pressure combined feed stream is at a pressure of at least 150 bara.

3. A method as claimed in claim 1, wherein step (a) further comprises cooling the one or more streams of recycled gas and/or the combined feed stream after compression via indirect heat exchange with one or more ambient temperature fluids, such that the high pressure combined feed stream is at about ambient temperature.

4. A method as claimed in claim 1, wherein the cooled combined feed stream is at a temperature of below 0° C. and wherein the further and expanded and cooled second feed stream is at a temperature of −110 to −140° C.

5. A method as claimed in claim 1, wherein in steps (b) and (e) the high pressure combined feed stream and the second feed stream are each expanded substantially isentropically.

6. A method as claimed in claim 1, wherein in step (c) the cooled combined feed stream is divided such that the second feed stream has the largest mass flow rate of the separate streams into which the cooled and combined feed stream is divided, and the first feed stream has the second largest flow rate of the streams into which the cooled and combined feed stream is divided.

7. A method as claimed in claim 1, wherein the mass flow rate of the second feed stream is 65 to 75%, and more preferably about 70%, of the mass flow rate of the cooled combined feed stream; and wherein the mass flow rate of the first feed stream is 20 to 30%, and more preferably about 25%, of the mass flow rate of the cooled combined feed stream.

8. A method as claimed in claim 1, wherein the vapor fraction of the further expanded and cooled second feed stream constitutes the majority of, and more preferably from 75 to 95 mole % of said stream.

9. A method as claimed in claim 1, wherein the first flash gas stream, after being warmed in step (f) via indirect heat exchange with the third feed stream, forms another one of the one or more streams of recycled gas.

10. A method as claimed in claim 1, wherein in step (d) the first feed stream is further cooled via indirect heat exchange with the gaseous refrigerant stream in a coil wound heat exchanger section, the first feed stream being further cooled in the tube side of the coil wound heat exchanger section and the gaseous refrigerant stream being warmed in the shell side of the coil wound heat exchanger section.

11. A method as claimed in claim 1, wherein step (a) comprises forming the high pressure combined feed stream by combining one or more streams of recycled gas with the natural gas feed stream to form the combined feed stream and then compressing the combined feed stream.

12. A method as claimed in claim 1, wherein step (g) comprises flashing the first, second and third LNG streams such that each stream has liquid and vapor fractions, and separating said liquid and vapor fractions to form the first LNG product stream from the liquid fractions of all of said streams and the first flash gas stream from the vapor fractions of all of said streams.

13. A method as claimed in claim 1, wherein step (c) comprises dividing the cooled combined feed stream into at least four separate streams, thereby forming a first feed stream, a second feed stream, a third feed stream and a fourth feed stream; and wherein the method further comprises the steps of:

(h) further cooling the fourth feed stream, via indirect heat exchange with a second flash gas stream, to form a fourth LNG stream; and (i) flashing the fourth LNG stream and the first LNG product stream such that each stream has liquid and vapor fractions, and separating said liquid and vapor fractions to form a second LNG product stream from the liquid fraction of one or both of said streams and the second flash gas stream from the vapor fraction of one or both of said streams.

14. A method as claimed in claim 13, wherein step (i) comprises flashing the fourth LNG stream and the first LNG product stream such that each stream has liquid and vapor fractions, and separating said liquid and vapor fractions to form the second LNG product stream from the liquid fractions of both of said streams and the second flash gas stream from the vapor fractions of both of said streams.

15. A system for liquefying natural gas via the method of claim 1, the system comprising:

a compression train, comprising one or more compressors, for forming a high pressure combined feed stream by combining one or more streams of recycled gas with a natural gas feed stream to form a combined feed stream and compressing either the combined feed stream, or the one or more recycle streams prior to combination with the natural gas feed stream, or both;

a first expansion device, in fluid flow communication with the compression train, for receiving and expanding the high pressure combined feed stream to cool the stream and thereby form a cooled combined feed stream;

a set of conduits in fluid flow communication with the first expansion device for dividing the cooled combined feed stream into at least three separate streams comprising a first feed stream, a second feed stream and a third feed stream, the set of conduits comprising a first conduit for receiving the first feed stream, a second conduit for receiving the second feed stream and a third conduit for receiving the third feed stream;

a first heat exchanger section in fluid flow communication with the first conduit for receiving and further cooling the first feed stream via indirect heat exchange with a gaseous refrigerant stream, the first feed stream being cooled to form a first LNG stream and the gaseous refrigerant stream being warmed to form a stream of warmed gaseous refrigerant that forms one of the one or more streams of recycled gas;

a second expansion device in fluid flow communication with the second conduit for receiving and further expanding the second feed stream to further cool said stream and thereby form a further expanded and cooled second feed stream that is two-phase, having liquid and vapor fractions;

a first separation section, in fluid flow communication with the second expansion device and first heat exchanger section, for receiving the further expanded and cooled second feed stream and separating the liquid and vapor fractions of said stream to form the gaseous refrigerant stream from the vapor fraction and a second LNG stream from the liquid fraction;

a second heat exchanger section, in fluid flow communication with the third conduit for receiving and further cooling the third feed stream, via indirect heat exchange with a first flash gas stream, to form a third LNG stream; and a third expansion device or set of expansion devices for receiving and flashing the first, second and third LNG streams such that each stream has liquid and vapor fractions, and a second separation section or set of separation sections, in fluid flow communication with the third expansion device or set of expansion devices, for separating said liquid and vapor fractions to form a first LNG product stream from the liquid fraction of one or more of said streams and the first flash gas stream from the vapor fraction of one or more of said streams.

16. A method of liquefying natural gas as claimed in claim 1, wherein step (a) comprises:

expanding a natural gas stream, containing heavy components, to form a cooled natural gas feed stream;

(ii) separating the cooled natural gas feed stream into a gaseous natural gas feed stream that is depleted in heavy components and a liquid stream that is enriched in heavy components which is the natural gas feed stream;

(iii) combining the gaseous natural gas feed stream with the one or more streams of recycled gas to form the combined feed stream, said streams being combined at a pressure below the critical pressure of methane, and the gaseous natural gas feed stream not being subjected to externally driven compression prior to being combined with the one or more streams of recycled gas; and (iv) compressing the combined feed stream to form the high pressure combined feed stream.

17. A system as claimed in claim 15, wherein the compression train forms the high pressure combined feed stream by combining the one or more streams of recycled gas with a gaseous natural gas feed stream that is depleted in heavy components which is the natural gas feed stream to form a combined feed stream, and compressing the combined feed stream to form the high pressure combined feed stream, the gaseous natural gas feed stream and one or more streams of recycled gas being combined at a pressure below the critical pressure of methane and the gaseous natural gas feed stream not being subjected to externally driven compression prior to being combined with the one or more streams of recycled gas; and wherein the system further comprises:

a fourth expansion device for receiving and expanding a natural gas stream, containing heavy components, to form a cooled natural gas feed stream; and one or more separation devices in fluid flow communication with the fourth expansion device for receiving and separating the cooled natural gas feed stream into the gaseous natural gas feed stream that is depleted in heavy components and a liquid stream that is enriched in heavy components.

* * * * *